US009291144B2

(12) United States Patent
Yonetamari

(10) Patent No.: US 9,291,144 B2
(45) Date of Patent: Mar. 22, 2016

(54) HEATER AND GLOW PLUG INCLUDING THE SAME

(75) Inventor: Atsushi Yonetamari, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 242 days.

(21) Appl. No.: 13/980,628

(22) PCT Filed: Jan. 20, 2012

(86) PCT No.: PCT/JP2012/051170
§ 371 (c)(1),
(2), (4) Date: Jul. 19, 2013

(87) PCT Pub. No.: WO2012/099232
PCT Pub. Date: Jul. 26, 2012

(65) Prior Publication Data

US 2013/0291819 A1 Nov. 7, 2013

(30) Foreign Application Priority Data

Jan. 20, 2011 (JP) ..... 2011-009953

(51) Int. Cl.
*F02P 19/02* (2006.01)
*H05B 3/08* (2006.01)
(Continued)

(52) U.S. Cl.
CPC ..... *F02P 19/02* (2013.01); *F23Q 7/001* (2013.01); *H05B 3/48* (2013.01); *H05B 2203/027* (2013.01)

(58) Field of Classification Search
CPC ..... F23Q 7/001; F23Q 2007/004; F23Q 7/00; H05B 2203/027; H05B 3/141; H05B 3/48; H05B 3/18; H05B 1/0236; H05B 3/06; H05B 3/20; H05B 3/283; H05B 3/44
USPC ..... 123/143 B, 143 A, 143 C; 219/541, 542, 219/545, 547, 550
See application file for complete search history.

(56) References Cited

U.S. PATENT DOCUMENTS 4,912,305 A * 3/1990 Tatemasu et al. ..... 219/544
5,233,166 A * 8/1993 Maeda et al. ..... 219/552
6,326,595 B2 * 12/2001 Taniguchi et al. ..... 219/270
(Continued)

FOREIGN PATENT DOCUMENTS

JP 61-195580 A 8/1986
JP S61-186971 U 11/1986
(Continued)

OTHER PUBLICATIONS

Chinese Office Action with English concise explanation, Chinese Patent Application No. 201280005879.8, Oct. 10, 2014, 7 pp.

*Primary Examiner* — Lindsay Low
*Assistant Examiner* — Long T Tran
(74) *Attorney, Agent, or Firm* — Volpe and Koenig, P.C.

(57) ABSTRACT

A heater of one embodiment of this invention has a resistor having a folded shape, a pair of leads joined to each end of the resistor, an insulating base in which the resistor is buried in the front side thereof and the pair of leads are buried in the rear side thereof, in which the resistor and the leads are overlapped in a direction perpendicular to the axial direction of the leads at junctions between the resistor and the leads and the rear end of the junction between one end of the resistor and one of the leads is located rearward relative to the rear end of the junction between the other end of the resistor and the other lead.

6 Claims, 3 Drawing Sheets

(51) Int. Cl.
*F23Q 7/00* (2006.01)
*H05B 3/48* (2006.01)

(56) References Cited

U.S. PATENT DOCUMENTS

| | | | | |
|---|---|---|---|---|
| 6,483,079 | B2 * | 11/2002 | Sato et al. | 219/270 |
| 6,483,089 | B1 * | 11/2002 | Wright et al. | 219/621 |
| 6,599,457 | B2 * | 7/2003 | Watanabe et al. | 264/122 |
| 6,689,990 | B2 * | 2/2004 | Taniguchi et al. | 219/270 |
| 2002/0162830 | A1 * | 11/2002 | Taniguchi et al. | 219/270 |
| 2002/0162831 | A1 | 11/2002 | Taniguchi et al. | |
| 2006/0011602 | A1 | 1/2006 | Konishi et al. | |

FOREIGN PATENT DOCUMENTS

| | | | |
|---|---|---|---|
| JP | 4-257615 | A | 9/1992 |
| JP | 2000-130754 | A | 5/2000 |
| JP | 2000-356343 | A | 12/2000 |
| JP | 2001-324141 | A | 11/2001 |
| JP | 2002-243150 | A | 8/2002 |
| JP | 2002-334768 | A | 11/2002 |
| JP | 2003-022889 | A | 1/2003 |
| JP | 2006-049279 | A | 2/2006 |

* cited by examiner

HEATER AND GLOW PLUG INCLUDING THE SAME

TECHNICAL FIELD

The present invention relates to a heater to be used for an ignition heater or a heater for a flame sensor in a combustion type in-vehicle heating device, an ignition heater for various combustion devices such as an oil fan heater, a heater for a glow plug of a car engine, a heater for various sensors such as an oxygen sensor, a heater for heating a measurement device, and the like, and to a glow plug including the heater.

BACKGROUND ART

A glow plug is used to aid starting a diesel engine. The glow plug is configured to include a heater having, for example, a resistor having a folded shape, a pair of leads joined to each end of the resistor, and an insulating base in which the resistor is buried at the front side thereof and the pair of leads are buried at the rear side thereof. The glow plug of such configuration has been desired to have higher temperature performance and higher durability because the glow plug is also used to provide after glow for exhaust gas purification, for example, in order to comply with higher environmental standards.

In order to satisfy such requirements, a ceramic grow plug which can be used at higher temperature has been used. However, microcracks or the like due to resistance changes or thermal expansion differences tend to occur at junctions between the resistor and the leads, and resistance changes and dielectric breakdown (short-circuit) between the leads caused by the microcracks or the like have posed problems.

Then, the problems are, for example, addressed by configuring a joint surface of the resistor and the lead where microcracks are likely to occur to incline as viewed in cross section parallel to the axis of the leads and increase the durability by increasing the area of the joint surface (PTLs 1 and 2).

CITATION LIST

Patent Literature

PTL 1: Japanese Unexamined Patent Application Publication No. 2002-334768

PTL 2: Japanese Unexamined Patent Application Publication No. 2003-22889

SUMMARY OF INVENTION

Technical Problem

However, at the junctions between the resistor and the leads where the resistance value changes, a load is still high due to difference in contraction between the resistor and the leads. Since the resistor and the leads are overlapped in a direction perpendicular to the axial direction of the leads and each of the junctions between both ends of the resistor and the leads is located in the cross section cut along the width direction perpendicular to the axial direction of the leads, stresses due to the thermal expansion in the width direction at the respective junctions are combined particularly when the temperature increases rapidly. As a result, microcracks are likely to occur around the junctions between the resistor and the leads, particularly at a position between the junctions facing in the insulating base, which may cause dielectric breakdown (short-circuit) between the leads.

The present invention has been made in view of the above-described circumstances. It is an object of the invention to provide a heater in which the occurrence of dielectric breakdown between the leads caused by cracks generated at the junctions between the resistor and the leads is suppressed and a glow plug having the heater.

Solution to Problem

A heater of the invention includes a resistor having a folded shape, a pair of leads joined to each end of the resistor, and an insulating base in which the resistor is buried at the front side thereof and the pair of leads are buried at the rear side thereof, in which, at junctions between the resistor and the leads, the resistor and the leads are overlapped in a direction perpendicular to the axial direction of the leads, and the rear end of the junction between one end of the resistor and one of the leads is located rearward relative to the rear end of the junction between the other end of the resistor and the other lead.

In the configuration of the heater of the invention, the leads surround the ends of the resistor at the junctions as viewed in the cross section perpendicular to the axial direction of the leads.

In the configuration of the heater of the invention, the one end of the resistor is a positive side.

In the configuration of the heater of the invention, the position of the top end of the junction between the one end of the resistor and the one of the leads and the position of the top end of the junction between the other end of the resistor and the other lead are different from each other relative to the axial direction of the leads.

In the configuration of the heater of the invention, the top end of the junction between the one end of the resistor and the one of the leads is located rearward relative to the rear end of the junction between the other end of the resistor and the other lead.

The glow plug of the invention includes the heater described in any one of the configurations described above and a metal holding member which is electrically coupled to an end of one of the pair of leads and holds the heater.

Advantageous Effects of Invention

According to the heater of the invention, since the rear end of the junction between one end of the resistor and one lead is located rearward relative to the rear end of the junction between the other end of the resistor and the other lead, a stress caused by combining, in a width direction perpendicular to the axial direction of the leads, thermal stresses applied to the rear ends of respective junctions where a degree of thermal expansion is highest in rapid increase in temperature becomes low and a load becomes low, and therefore occurrence of dielectric breakdown (short-circuit) can be reduced.

DESCRIPTION OF EMBODIMENT

An embodiment of the heater of the invention is described in detail with reference to the drawings.

Figure 1:
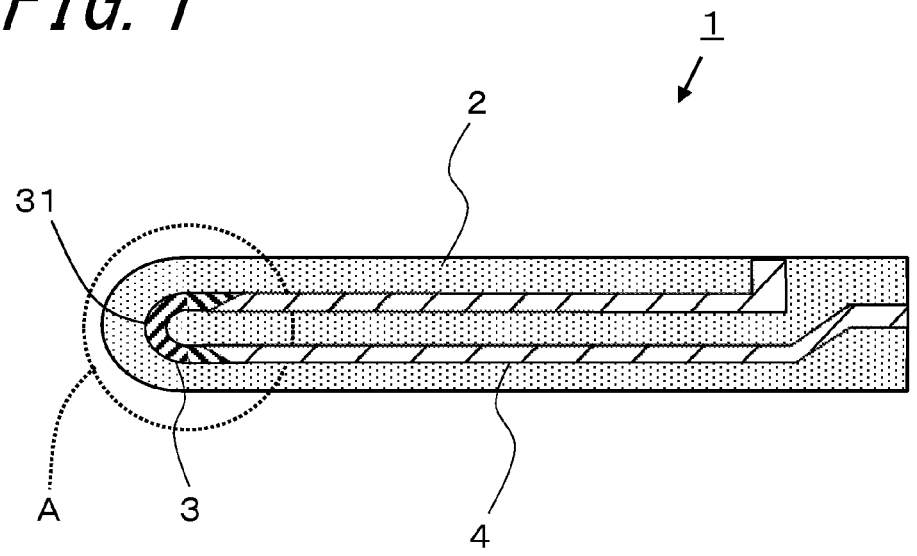
FIG. 1 is a longitudinal cross sectional view illustrating an example of an embodiment of a heater according to the invention.
Figure 2:
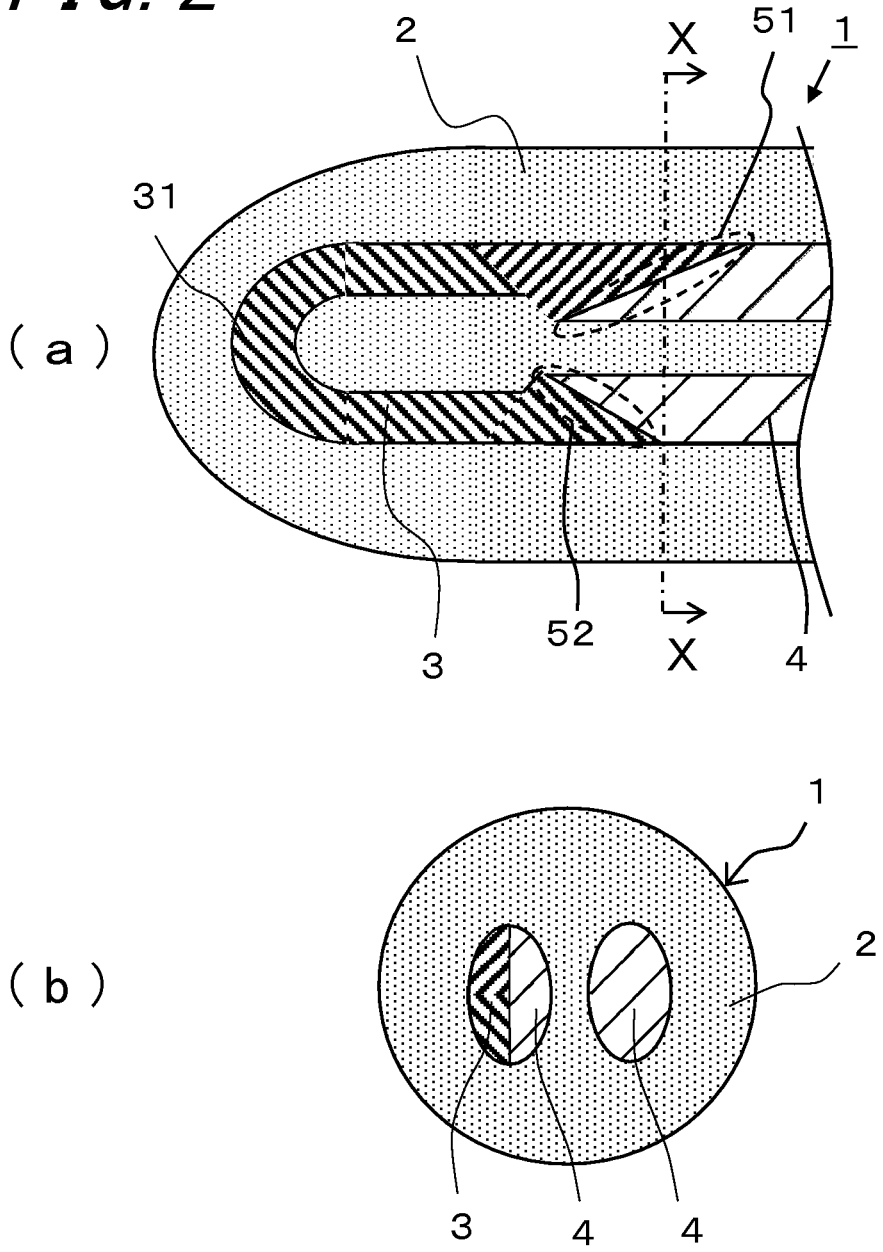
FIG. 2 Part (a) is an enlarged cross sectional view of a region A containing junctions between a resistor and leads illustrated in FIG. 1 and Part (b) is an X-X line cross sectional view in Part (a).
Figure 3:
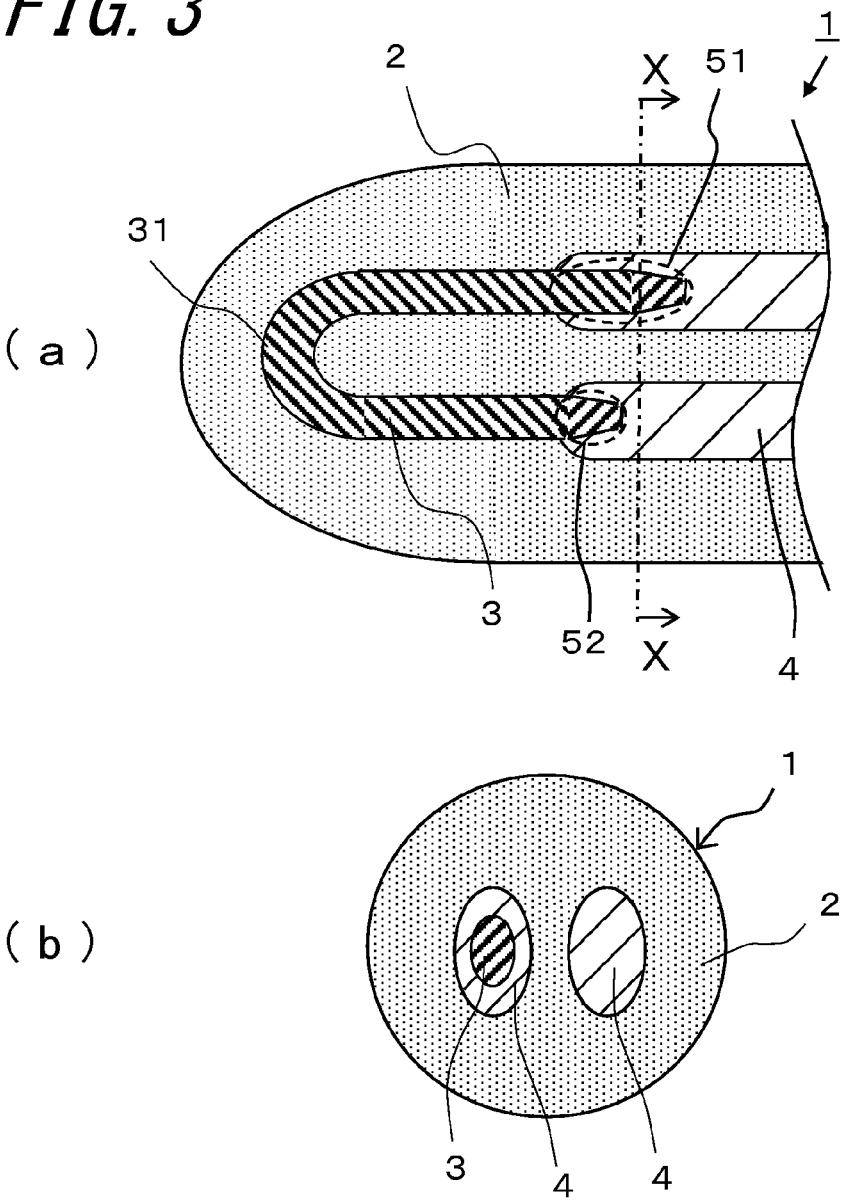
FIG. 3 Part (a) is an enlarged cross sectional view illustrating another example of the embodiment of the heater according to the invention in which a region containing junctions between a resistor and leads is enlarged and Part (b) is an X-X line cross sectional view in Part (a).

FIG. 1 is a longitudinal cross sectional view illustrating an example of an embodiment of the heater of the invention. Part (a) of FIG. 2 is an enlarged cross sectional view in which a region A containing junctions between a resistor and leads illustrated in FIG. 1 is enlarged. Part (b) of FIG. 2 is an X-X line cross sectional view in Part (a) of FIG. 2. Part (a) of FIG. 3 is an enlarged cross sectional view illustrating another example of the embodiment of the heater of the invention in which a region containing junctions between a resistor and leads is enlarged. Part (b) of FIG. 3 is an X-X line cross sectional view in Part (a) of FIG. 3.

A heater 1 of the embodiment has a resistor 3 having a folded shape, a pair of leads 4 joined to each end of the resistor 3, an insulating base 2 in which the resistor 3 is buried at the front side thereof and the pair of leads 4 are buried at the rear side thereof, in which the resistor 3 and the leads 4 are overlapped in a direction perpendicular to the axial direction of the leads 4 at junctions 51 and 52 between the resistor 3 and the leads 4 and the rear end of the junction 51 between one end of the resistor 3 and one of the leads 4 is located rearward relative to the rear end of the junction 52 between the other end of the resistor 3 and the other lead 4.

The insulating base 2 in the heater 1 of this embodiment is formed in a rod shape or a plate shape, for example. In the insulating base 2, the resistor 3 and the pair of leads 4 are buried. Herein, the insulating base 2 preferably contains ceramics. This allows providing the heater 1 with high reliability in rapid increase in temperature. Specifically, ceramics having electrical insulation properties, such as oxide ceramics, nitride ceramics, and carbide ceramics may be used. In particular, it is preferable that the insulating base 2 contain silicon nitride ceramics. This is because, in the silicon nitride ceramics, the silicon nitride which is the main component is good in terms of high intensity, high toughness, high insulation properties, and heat resistance. The insulating base 2 containing the silicon nitride ceramics can be obtained by, for example, mixing 3 to 12% by mass of a rare earth element oxide such as $Y_2O_3$, $Yb_2O_3$, and $Er_2O_3$ as a sintering assistant, 0.5 to 3% by mass of $Al_2O_3$, and $SiO_2$ the amount of which contained in a sintered compact is 1.5 to 5% by mass, based on the silicon nitride as the main component, molding the mixture into a predetermined shape, and then baking the molded body in hot-pressing at 1650 to 1780° C. The length of the insulating base 2 is formed to be 20 to 50 mm, for example. The diameter of the insulating base 2 is formed to be 3 to 5 mm, for example.

When using the insulating base 2 containing the silicon nitride ceramics, it is preferable to mix and disperse $MoSiO_2$, $WSi_2$, and the like. In this case, the coefficient of thermal expansion of the silicon nitride ceramics serving as the base material can be close to the coefficient of thermal expansion of the resistor 3, and the durability of the heater 1 can be increased.

The resistor 3 buried in the insulating base 2 has a folded shape in the longitudinal cross section, in which a portion around the center of the folded shape located at the top end (around the midpoint of the folded portion) serves as a heat generating portion 31 which generates heat most. The resistor 3 is buried at the top end side of the insulating base 2. The distance from the top end (around the center of the folded shape) of the resistor 3 to the rear end (the rear end of the junction 51) of the resistor 3 is, for example, 2 to 10 mm. The shape of the axial transverse section of the resistor 3 may be any shape, such as a circle, an oval, or a rectangle, and is usually formed in such a manner that the cross sectional area is smaller than that of the leads 4 described later.

As materials of the resistor 3, those containing carbides, nitrides, silicides, and the like of, for example, W, Mo, or Ti as the main component can be used. When the insulating base 2 contains the silicon nitride ceramics, tungsten carbide (WC) is good as a material of the resistor 3 among the materials mentioned above in terms of a small difference in the coefficient of thermal expansion from the insulating base 2, high heat resistance, and low specific resistance. When the insulating base 2 contains the silicon nitride ceramics, it is preferable that the resistor 3 contain WC which is an inorganic conductive material as the main constituent, in which the content of the silicon nitride to be added thereto is 20% by mass or more. For example, since a conductive component serving as the resistor 3 has a higher coefficient of thermal expansion as compared with that of the silicon nitride in the insulating base 2 containing the silicon nitride ceramics, the conductive component is usually in a state where tensile stress is applied. Thus, silicon nitride is added into the resistor 3, thereby the coefficient of thermal expansion of the resistor 3 being close to that of the insulating base 2 and the stress caused by the difference in the coefficient of thermal expansion in temperature rising and temperature lowering of the heater 1 can be eased. When the content of the silicon nitride contained in the resistor 3 is 40% by mass or lower, the resistance value of the resistor 3 can be made relatively small and stabilized. Therefore, the content of the silicon nitride contained in the resistor 3 is preferably 20% by mass to 40% by mass. The content of the silicon nitride is more preferably 25% by mass to 35% by mass. As the similar additive to the resistor 3, 4% by mass to 12% by mass of boron nitride can be added instead of the silicon nitride.

The leads 4 buried in the insulating base 2 are connected to the resistor 3 at one end side and are drawn to the surface of the insulating base 2 at the other end side. The leads 4 illustrated in FIG. 1 are joined to each of both ends (one end and the other end) of the resistor 3 forming a folded shape from one end to the other end. One end of one lead 4 is connected to one end of the resistor 3 and the other end of the one lead 4 is exposed from the side surface toward the rear end of the insulating base 2. One end of the other lead 4 is connected to the other end of the resistor 3 and the other end of the other lead 4 is exposed from the rear end of the insulating base 2.

The leads 4 are formed using the same material as that of the resistor 3, in which the resistance value per unit length is low by, for example, increasing the cross sectional area to be larger than that of the resistor 3 or reducing the content of the material forming the insulating base 2 to be lower than that of the resistor 3. In particular, WC is preferable as the material of the leads 4 in terms of a small difference in the coefficient of thermal expansion from the insulating base 2, high heat resistance, and low specific resistance. Preferably, the leads 4 contain WC which is an inorganic conductive material as the main constituent and silicon nitride is added thereto in such a manner that the content thereof is 15% by mass or more. As an increase in the content of the silicon nitride, the coefficient of thermal expansion of the leads 4 can be close to the coefficient of thermal expansion of the silicon nitride constituting the insulating base 2. When the content of the silicon nitride is 40% by mass or lower, the resistance value of the leads 4 becomes small and is stabilized. Therefore, the content of the silicon nitride is preferably 15% by mass to 40% by mass. More preferably, the content of the silicon nitride is 20% by mass to 35% by mass.

At the junctions 51 and 52 between the resistor 3 and the leads 4, the resistor 3 and the leads 4 are overlapped in a direction perpendicular to the axial direction of the leads 4 and the rear end of the junction 51 between one end of the resistor 3 and one of the leads 4 is located rearward relative to the rear end of the junction 52 between the other end of the resistor 3 and the other lead 4.

Herein, the phrase "at the junctions 51 and 52 between the resistor 3 and the leads 4, the resistor 3 and the leads 4 are overlapped in a direction perpendicular to the axial direction of the leads 4" refers to a shape such that, when the junctions 51 and 52 are viewed in the axial transverse section perpendicular to the axial direction of the leads 4, the resistor 3 and the leads 4 are included therein. For example, when the junctions 51 and 52 are viewed in the longitudinal cross section including both axes of one lead 4 and the other lead 4, the leads 4 are disposed inside and the resistor is disposed outside and the junction surfaces incline from a direction perpendicular to the axial direction of the leads 4. The length in the axial direction of the leads 4 at the junctions 51 and 52 (the distance from the top end to the rear end of the junctions 51 and 52) is 0.5 to 3 mm, for example.

The shape of the junctions 51 and 52, as illustrated in FIG. 2, for example, is a shape in which the junction surfaces incline from a direction perpendicular to the axial direction of the leads 4 as viewed in the longitudinal cross section of the heater 1. However, the shape is not limited thereto and includes a shape in which the leads 4 surround the ends of the resistor 3 as viewed in the cross section perpendicular to the axial direction of the leads 4 as illustrated in FIG. 3 described later.

When, as described above, the junction surfaces have a shape of inclining from a direction perpendicular to the axial direction of the leads 4, microcracks are likely to occur due to a stress in a width direction caused by combining, in a width direction perpendicular to the axial direction of the leads, thermal stresses applied to the rear ends of respective junctions 51 and 52 where a degree of thermal expansion is highest in rapid increase in temperature, which may cause dielectric breakdown (short-circuit) between the leads.

Thus, the rear end of the junction 51 between one end of the resistor 3 and one of the leads 4 is located rearward relative to the rear end of the junction 52 between the other end of the resistor 3 and the other lead 4. In other words, the position of the rear end of the junction 51 and the position of the rear end of the junction 52 are different (shifted) in the axial direction of the leads 4.

With respect to the distance of the shift between the position of the rear end of the junction 51 and the position of the rear end of the junction 52, it is effective that the rear end of the junction 51 is located rearward by 10 μm to 2 mm relative to the rear end of the junction 52. When the position of the top end of the junction 51 and the position of the top end of the junction 52 are the same with respect to the axial direction of the leads 4, the inclination angle in which one junction surface (for example, junction surface at a positive side) inclines from a direction perpendicular to the axial direction of the leads 4 preferably further inclines by 0.1 to 15° than the inclination angle in which the other junction surface (for example, junction surface at a negative side) inclines from a direction perpendicular to the axial direction of the leads 4.

According to this configuration, a stress in a width direction caused by combining, in a width direction perpendicular to the axial direction of the leads 4, thermal stresses applied to the rear ends of respective junctions where a degree of thermal expansion is highest in rapid increase in temperature becomes low and a load becomes low, and therefore occurrence of dielectric breakdown (short-circuit) can be reduced.

Herein, as illustrated in FIG. 3, it is preferable that the leads 4 surround the ends of the resistor 3 at the junctions 51 and 52 as viewed in the cross section perpendicular to the axial direction of the leads 4. With this shape, the leads 4 covering the resistor 3 which thermally expands in rapid increase in temperature may function as a shock absorbing material for the insulating ceramics having a different coefficient of linear expansion and may reduce a load, and therefore occurrence of dielectric breakdown (short-circuit) can be further reduced.

It is preferable that one end of the resistor 3 located rearward is a positive side. With this shape, since the rear end of the junction 51 at the positive side to which a load is first applied by a rush current when applying a current is shifted from the cross section of the resistor 3 (junction 52) where a degree of thermal expansion is highest in a width direction perpendicular to the axial direction of the leads 4 (there is no resistor 3 when viewed in the width direction from the rear end of the junction 51), a load in repeating use can be dispersed, and therefore occurrence of dielectric breakdown (short-circuit) can be further reduced.

It is preferable that the position of the top end of the junction 51 between one end of the resistor 3 and one of the leads 4 and the position of the top end of the junction 52 between the other end of the resistor 3 and the other lead 4 be different from each other (shifted) in the axial direction of the leads 4. With this shape, since not only the rear end of the junction 51 and the rear end of the junction 52 but the top end of the junction 51 and the top end of the junction 52 are shifted in the axial direction of the leads 4, a stress combined in a width direction perpendicular to the axial direction of the leads 4 in rapid increase in temperature becomes low and a load becomes low, and therefore occurrence of dielectric breakdown (short-circuit) can be reduced.

It is preferable that the top end of the junction 51 between one end of the resistor 3 and one of the leads 4 is located rearward relative to the rear end of the junction 52 between the other end of the resistor 3 and the other lead 4. With this shape, since the junction 51 and the junction 52 are completely shifted in the axial direction of the leads 4, a stress combined in a width direction perpendicular to the axial direction of the leads 4 in rapid increase in temperature is hardly generated and a load becomes low, and therefore occurrence of dielectric breakdown (short-circuit) can be reduced.

The heater 1 described above can be used for a glow plug (not illustrated). More specifically, the glow plug (not illustrated) of the invention is configured to include the heater 1 described above and a metal holding member (sheath metal fitting) which is electrically coupled to an end of one of the pair of leads 4 constituting the heater 1 and holds the heater 1. With this configuration, since occurrence of dielectric breakdown (short-circuit) is reduced in the heater 1, a glow plug which can be used over a long period of time can be achieved.

Next, an example of a method for manufacturing the heater 1 of this embodiment is described.

The heater 1 of this embodiment can be formed by, for example, an injection molding process or the like using a die having a shape of the resistor 3, the leads 4, and the insulating base 2 of the configuration of this embodiment.

First, a conductive paste to be formed into the resistor 3 and the leads 4 containing conductive ceramic powder, a resin binder, and the like is produced, and also a ceramic paste to be formed into the insulating base 2 containing insulating ceramic powder, a resin binder, and the like is produced.

Next, a molded body (molded body a) of a conductive paste having a predetermined pattern to be formed into the resistor 3 is formed using the conductive paste by injection molding or the like. Subsequently, the conductive paste is charged into the die in a state where the molded body a is held in the die to form a molded body (molded body b) of the conductive paste of a predetermined pattern to be formed into the leads 4. Thus, the molded body a and the molded body b connected to the molded body a are held in the die.

Next, a part of the die is exchanged to one for molding the insulating base 2 in the state where the molded body a and the molded body b are held in the die, and then a ceramic paste to be formed into the insulating base 2 is charged into the die. Thus, a molded body (molded body d) of the heater 1 in which the molded body a and the molded body b are buried in a molded body (molded body c) of the ceramic paste is obtained.

Next, the obtained molded body d is fired at a temperature of 1650° C. to 1780° C. at a pressure of 30 MPa to 50 MPa, whereby the heater 1 can be produced. The firing is preferably performed in a non-oxidizing gas atmosphere such as a hydrogen gas atmosphere or the like.

The heater 1 of this embodiment is completed by the above-described method.

EXAMPLE

The heater of Example of the invention was produced as follows.

First, a conductive paste containing 50% by mass of tungsten carbide (WC) powder, 35% by mass of silicon nitride ($Si_3N_4$) powder, and 15% by mass of a resin binder was injection molded in a die, whereby a molded body a to be formed into a resistor having the shape illustrated in FIG. 1 was produced.

Next, by charging the conductive paste to be formed into leads into the die in a state where the molded body a was held in the die, the conductive paste was connected to the molded body a, whereby a molded body b to be formed into the leads having the shape illustrated in FIG. 1 was produced.

Next, a ceramic paste containing 85% by mass of silicon nitride ($Si_3N_4$) powder, 10% by mass of oxide ($Yb_2O_3$) of ytterbium (Yb) as a sintering assistant, and 5% by mass of tungsten carbide (WC) for making the coefficient of thermal expansion close to those of the resistor and the leads was injection molded in the die in a state where the molded body a and the molded body b were held in the die. Thus, a molded body d having a configuration such that the molded body a and the molded body b were buried in the molded body c to be formed into an insulating base was produced.

Next, the obtained molded body d was placed in a cylindrical carbon die, and then sintered by hot-pressing at a temperature of 1700° C. at a pressure of 35 MPa in a non-oxidizing gas atmosphere containing nitrogen gas, whereby a heater of Example of the invention was produced. Then, a tubular metal holding member was brazed to a lead end exposed to the side surface near the rear end of the obtained heater to produce a glow plug.

The position of the top end of the junction 51 and the position of the top end of the junction 52 in the axial direction of the leads are in agreement with each other. The length of the junction 51 in the axial direction of the leads was 0.9 mm and the length of the junction 52 in the axial direction of the leads was 1.0 mm. The position of the rear end of the junction 51 and the position of the rear end of the junction 52 in the axial direction of the leads were shifted by 0.1 mm.

As Comparative Example, a glow plug in which the position of the top end of the junction 51 and the position of the top end of the junction 52 in the axial direction of the leads were in agreement with each other and the position of the rear end of the junction 51 and the position of the rear end of the junction 52 in the axial direction of the leads were also in agreement with each other was produced.

A cooling/heating cycle test was performed using the glow plugs. With respect to the conditions of the cooling/heating cycle test, a voltage to be applied was set such that the temperature of the resistor was 1400° C. by energizing the heater, and 1) energization for 5 minutes and 2) non-energization for 2 minutes were defined as one cycle, and then, the cycle was repeated 10,000 times.

When changes in the resistance value of the heaters before and after the cooling/heating cycle test were measured, the resistance change was 1% or lower and microcracks were not observed in the sample of Example of the invention. On the other hand, in the sample of Comparative Example, the resistance change was 5% or higher and microcracks were observed.

REFERENCE SIGNS LIST

1: Heater
2: Insulating base
3: Resistor
31: Heating Portion
4: Lead
51, 52: Junction

The invention claimed is:

1. A heater, comprising: a resistor comprising a folded shape; a first lead and a second lead respectively joined to each end of the resistor; and an insulating base in which the resistor is buried at a front side thereof and the first lead and the second lead are buried in a rear side thereof, wherein at junctions between the resistor and the first and second leads, the resistor and the first and second leads being overlapped in a direction perpendicular to an axial direction of the first and second leads, and an endpoint of a rear end of the junction between a first end of the resistor and the first lead is different in the axial direction than an endpoint of a rear end of the junction between a second end of the resistor and the second lead.

2. The heater according to claim 1, wherein;
the first and second leads respectively surround the first and second ends of the resistor at the respective endpoints of the junctions in a cross section perpendicular to the axial direction of the first and second leads.

3. The heater according to claim 1, wherein;
the first end of the resistor is a positive side.

4. The heater according to claim 1, wherein;
a position of a top end of the junction between the first end of the resistor and the first lead and a position of a top end of the junction between the second end of the resistor and the second lead are different from each other relative to the axial direction of the first and second leads.

5. The heater according to claim 1, wherein;
a top end of the junction between the first end of the resistor and the first lead is located rearward relative to the rear end of the junction between the second end of the resistor and the second lead.

6. A glow plug, comprising:
the heater according to claim 1; and
a metal holder which is electrically coupled to an end of one of the first or second leads and holds the heater.

* * * * *